US009093824B2

(12) United States Patent
Fukushima et al.

(10) Patent No.: US 9,093,824 B2
(45) Date of Patent: Jul. 28, 2015

(54) SPARK PLUG

(75) Inventors: Hoju Fukushima, Nagoya (JP); Takamitsu Mizuno, Hashima (JP); Tsutomu Shibata, Owariasahi (JP); Toshitaka Honda, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 261 days.

(21) Appl. No.: 13/993,711

(22) PCT Filed: Sep. 6, 2011

(86) PCT No.: PCT/JP2011/004985

§ 371 (c)(1), (2), (4) Date: Jun. 13, 2013

(87) PCT Pub. No.: WO2012/081147

PCT Pub. Date: Jun. 21, 2012

(65) Prior Publication Data

US 2013/0264939 A1 Oct. 10, 2013

(30) Foreign Application Priority Data

Dec. 17, 2010 (JP) ..... 2010-281274

(51) Int. Cl.
*H01T 13/20* (2006.01)
*H01T 13/40* (2006.01)
*H01T 13/41* (2006.01)

(52) U.S. Cl.
CPC ..... *H01T 13/40* (2013.01); *H01T 13/41* (2013.01)

(58) Field of Classification Search
CPC ..... H01T 21/02; H01T 13/20; H01T 13/34; H01T 13/41
USPC ..... 315/58; 313/141, 143, 145; 445/7
See application file for complete search history.

(56) References Cited

U.S. PATENT DOCUMENTS

| | | | | |
|---|---|---|---|---|
| 4,173,731 | A | 11/1979 | Takagi et al. | 315/58 |
| 4,224,554 | A | 9/1980 | Nishio et al. | 315/53 |
| 6,160,342 | A | 12/2000 | Nishikawa et al. | 313/141 |
| 6,334,800 | B1 | 1/2002 | Nishikawa et al. | 445/7 |
| 7,402,941 | B2 * | 7/2008 | Shibata et al. | 313/145 |

FOREIGN PATENT DOCUMENTS

| | | | |
|---|---|---|---|
| FR | 2382752 | 3/1978 | |
| JP | 49-19236 | 2/1974 | |
| JP | 57-17586 | 1/1982 | H01T 13/00 |
| JP | 5152053 | 6/1993 | H01T 13/20 |
| JP | 11-233232 | 8/1999 | H01T 13/20 |
| JP | 2006-066086 | 3/2006 | H01T 13/20 |

* cited by examiner

OTHER PUBLICATIONS

Search Report issued in corresponding European Patent Application No. 11848027.6, dated.

*Primary Examiner* — Hai L Nguyen
(74) *Attorney, Agent, or Firm* — Kusner & Jaffe

(57) ABSTRACT

A spark plug having a connecting portion that electrically connects a center electrode with a metal terminal within an axial bore in an insulator. The connecting portion of the spark plug includes a resistor. A center electrode-side resistance, which is the resistance of a portion of the resistor that extends from the center thereof toward the center electrode in the axial direction, is larger than a metal terminal-side resistance, which is the resistance of a portion of the resistor that extends from the center thereof toward the metal terminal.

6 Claims, 4 Drawing Sheets

FIG. 3

| OVERALL RESISTANCE OF RESISTOR | SAMPLE No. | R1-R2 (kΩ) | RADIO NOISE PERFORMANCE |
|---|---|---|---|
| 2kΩ | 1 | 1.5 | ◎◎ |
| | 2 | 1 | ◎◎ |
| | 3 | 0.5 | ◎ |
| | 4 | 0.2 | ○ |
| | 5 | 0 | – |
| | 6 | −0.2 | × |
| | 7 | −0.5 | × |
| | 8 | −1 | × |
| | 9 | −1.5 | × |
| 5kΩ | 10 | 4 | ◎◎ |
| | 11 | 3 | ◎◎ |
| | 12 | 2 | ◎◎ |
| | 13 | 1 | ◎◎ |
| | 14 | 0 | – |
| | 15 | −1 | × |
| | 16 | −2 | × |
| | 17 | −3 | × |
| | 18 | −4 | × |
| 10kΩ | 19 | 6 | ◎◎ |
| | 20 | 5 | ◎◎ |
| | 21 | 4 | ◎◎ |
| | 22 | 3 | ◎◎ |
| | 23 | 2 | ◎◎ |
| | 24 | 1 | ◎◎ |
| | 25 | 0.7 | ◎ |
| | 26 | 0.2 | ○ |
| | 27 | 0 | – |
| | 28 | −0.2 | × |
| | 29 | −0.7 | × |
| | 30 | −1 | × |
| | 31 | −2 | × |
| | 32 | −3 | × |
| | 33 | −4 | × |
| | 34 | −5 | × |
| | 35 | −6 | × |

SPARK PLUG

FIELD OF THE INVENTION

The present invention relates to a spark plug, and, more particularly, to a spark plug including a resistor.

BACKGROUND OF THE INVENTION

In recent years, the voltage applied to a spark plug has been increased because of the increasing power of an internal combustion engine. Therefore, the level of radio noise (ignition noise) generated upon occurrence of spark discharge tends to increase. To reduce such radio noise, various techniques have been proposed (see, for example, Japanese Patent Application Laid-Open (kokai) No. H05-152053; Japanese Patent Application Laid-Open (kokai) No. H11-233232; and Japanese Patent Application Laid-Open (kokai) No. 2006-66086).

Generally, the level of radio noise generated by a spark plug can be reduced by increasing the resistance of a resistor disposed in a connecting portion that electrically connects a center electrode of the spark plug with its metal terminal. However, when the resistance of the resistor is increased in order to reduce the level of radio noise, ignition energy decreases, and this may cause deterioration of the sparking performance of the spark plug.

In view of the above problem, an object to be achieved by the present invention is to reduce the level of radio noise generated from a spark plug while suppressing deterioration of its sparking performance.

SUMMARY OF THE INVENTION

The present invention has been made to solve, at least partially, the above problem and can be embodied in the following modes or application examples.

The present invention may be implemented as a spark plug, as described above. Alternatively, the invention may be implemented as a method of producing the spark plug, a resistor in the spark plug, or a method of producing the resistor in the spark plug.

In accordance with a first aspect of the present invention, there is provided a spark plug comprising an insulator having an axial bore extending in an axial direction; a center electrode disposed at one end of the axial bore; a metal terminal disposed at the other end of the axial bore; and a connecting portion that electrically connects the center electrode with the metal terminal within the axial bore, wherein the connecting portion includes a resistor, and a center electrode-side resistance of the resistor is larger than a metal terminal-side resistance of the resistor, the center electrode-side resistance being a resistance of a portion of the resistor that extends from a center thereof toward the center electrode in the axial direction, the metal terminal-side resistance being a resistance of a portion of the resistor that extends from the center thereof toward the metal terminal.

In accordance with a second aspect of the present invention, there is provided a spark plug as described above according to application example 1, wherein a material forming the portion of the resistor that extends from the center thereof toward the center electrode in the axial direction has a resistance larger than a resistance of a material forming the portion of the resistor that extends from the center thereof toward the metal terminal.

In accordance with a third aspect of the present invention, there is provided a spark plug as described above according to application example 1 or 2, wherein the center electrode-side resistance is larger than the metal terminal-side resistance by at least 0.5 kΩ.

In accordance with a fourth aspect of the present invention, there is provided a spark plug as described above according to any one of application examples 1 to 3, wherein the center electrode-side resistance is larger than the metal terminal-side resistance by at least 1.0 kΩ.

In accordance with a fifth aspect of the present invention, there is provided a spark plug as described above according to any one of application examples 1 to 4, wherein the metal terminal-side resistance is 100Ω or larger.

In accordance with a sixth aspect of the present invention, there is provided a spark plug as described above according to any one of application examples 1 to 5, wherein the resistor has a substantially cylindrical shape, and has a diameter of 2.9 mm or smaller.

In the spark plug of application example 1, the center electrode-side resistance of the resistor is larger than the metal terminal-side resistance. This allows the level of radio noise generated upon occurrence of spark discharge to be effectively suppressed. Since it is not necessary to change the overall resistance of the resistor, deterioration of sparking performance can be suppressed.

In the spark plug of application example 2, the resistance of the material used for the portion of the resistor that extends toward the center electrode is different from the resistance of the material used for the portion of the resistor that extends toward the metal terminal. Therefore, the resistor can have different resistances in the portion extending toward the center electrode and the portion extending toward the metal terminal.

In the spark plug of application example 3, the center electrode-side resistance is at least 0.5 kΩ larger than the metal terminal-side resistance. In this case, the level of radio noise can be efficiently reduced.

In the spark plug of application example 4, the center electrode-side resistance is at least 1.0 kΩ larger than the metal terminal-side resistance. In this case, the level of radio noise can be efficiently reduced.

In the spark plug of application example 5, the metal terminal-side resistance is at least 100Ω. In this case, the level of radio noise can be reduced. Even when the resistor has a small resistance, the level of radio noise can be reduced by increasing the length of the resistor.

In the spark plug of application example 6, the diameter of the resistor is relatively small, i.e., 2.9 mm or smaller. In this case, the level of radio noise can be significantly reduced by setting the center electrode-side resistance to be larger than the metal terminal-side resistance.

BRIEF DESCRIPTION OF THE DRAWINGS

FIG. 3 is a table showing the results of evaluation of radio noise for different spark plug samples.

DETAILED DESCRIPTION OF PREFERRED EMBODIMENTS

Figure 1:
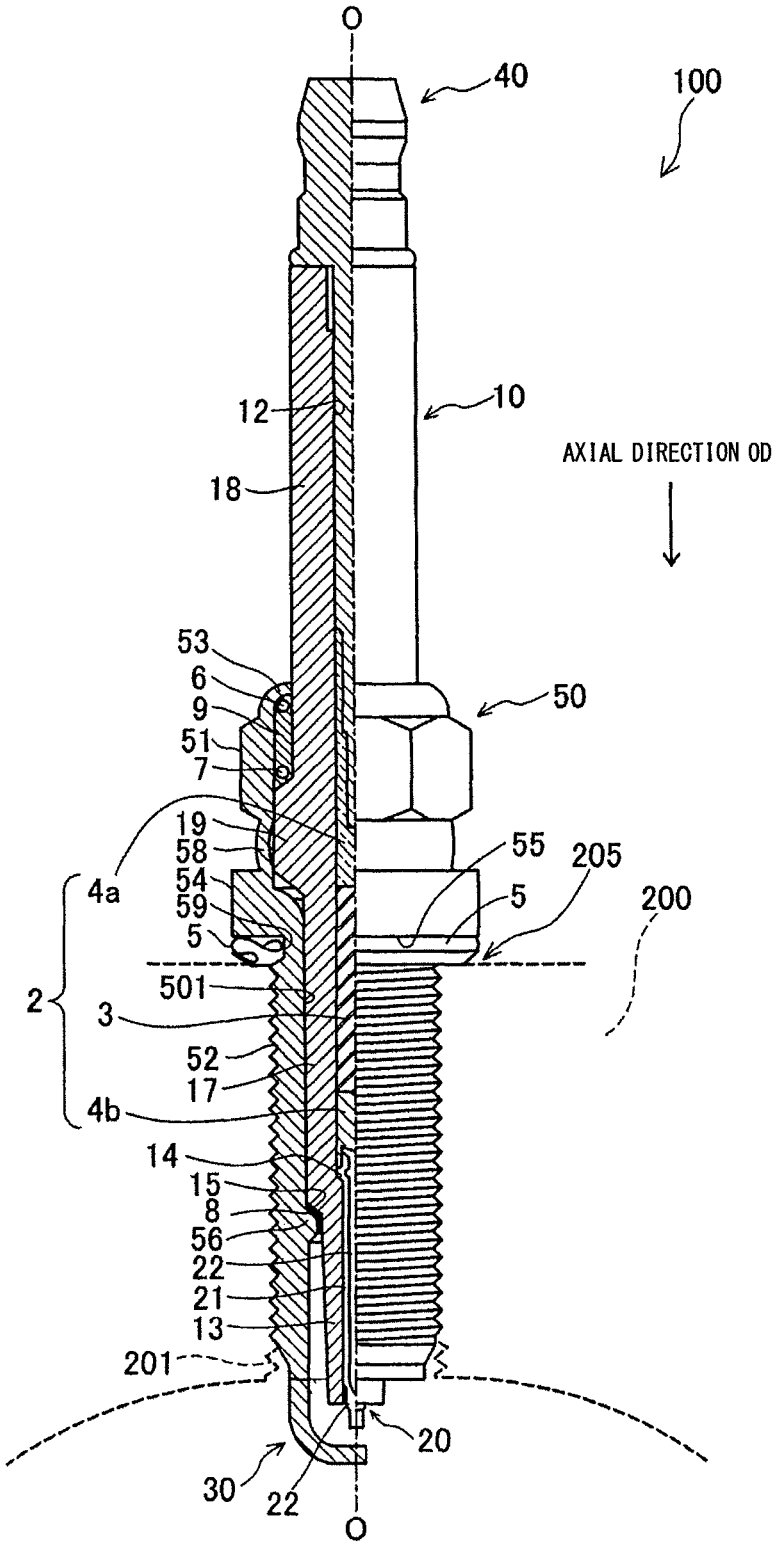
FIG. 1 is a partially sectional view of a spark plug according to an embodiment of the present invention.

FIG. 1 is a partially sectional view of a spark plug 100 according to an embodiment of the present invention. In FIG.

1, the right side of an axis O-O represented by a dot-dash line is an exterior front view, and the left side of the axis O-O is a sectional view obtained by cutting the spark plug 100 along a cross section passing through the center axis of the spark plug 100. In the following description, the lower side of the spark plug 100 in FIG. 1 in an axial direction OD is referred to as the front side of the spark plug 100, and the upper side is referred to as the rear side.

The spark plug 100 includes a ceramic insulator 10 serving as an insulator, a metallic shell 50, a center electrode 20, a ground electrode 30, and a metal terminal 40. The metallic shell 50 has an insertion hole 501 formed therethrough in the axial direction OD. The ceramic insulator 10 is inserted into the insertion hole 501 and held therein. The center electrode 20 is held in an axial bore 12 formed in the ceramic insulator 10 such that the center electrode 20 extends in the axial direction OD. The front end portion of the center electrode 20 protrudes frontward from the ceramic insulator 10. The ground electrode 30 is joined to the front end portion of the metallic shell 50. The metal terminal 40 is disposed rearward of the center electrode 20, and the rear end portion of the metal terminal 40 protrudes rearward from the ceramic insulator 10. A high-voltage cable (not shown) is connected to the metal terminal 40 via a plug cap (not shown) to apply a high voltage to the metal terminal 40.

As is well-known, the ceramic insulator 10 is formed by firing, for example, alumina and has a cylindrical tubular shape. The ceramic insulator 10 has, at its center in the radial direction, the axial bore 12 extending in the axial direction OD. A flange portion 19 having the largest outer diameter is formed substantially at the center of the ceramic insulator 10 in the axial direction OD, and a rear trunk portion 18 is formed rearward of the flange portion 19. A front trunk portion 17, that is smaller in outer diameter than the rear trunk portion 18, is formed frontward of the flange portion 19, and a leg portion 13, that is smaller in outer diameter than the front trunk portion 17, is formed frontward of the front trunk portion 17. The leg portion 13 is tapered in the frontward direction and exposed to a combustion chamber of an internal combustion engine when the spark plug 100 is mounted on an engine head 200 of the engine.

The metallic shell 50 is a cylindrical metallic member used to secure the spark plug 100 to the engine head 200 of the internal combustion engine. The metallic shell 50 holds the ceramic insulator 10 so as to surround a portion of the ceramic insulator 10 that extends from a part of the rear trunk portion 18 to the leg portion 13. More specifically, the spark plug 100 is configured such that the ceramic insulator 10 is inserted into the insertion hole 501 of the metallic shell 50, and the front and rear ends of the ceramic insulator 10 protrude from the front and rear ends, respectively, of the metallic shell 50. The metallic shell 50 is formed of low-carbon steel, and the entire metallic shell 50 is plated with, for example, nickel or zinc. A hexagonal columnar tool engagement portion 51 is provided at the rear end portion of the metallic shell 50. A spark plug wrench (not shown) is engaged with the tool engagement portion 51. The metallic shell 50 includes a mounting screw portion 52 having a screw thread that is to be threadingly engaged with a mounting screw hole 201 of the engine head 200 disposed in the upper portion of the internal combustion engine.

The metallic shell 50 has a flange-like seal portion 54 formed between the tool engagement portion 51 and the mounting screw portion 52. An annular gasket 5 formed by folding a plate is fitted to a screw neck 59 between the mounting screw portion 52 and the seal portion 54. When the spark plug 100 is mounted on the engine head 200, the gasket 5 is crushed and deformed between a seat surface 55 of the seal portion 54 and a mounting surface 205 around the opening of the mounting screw hole 201. The deformation of the gasket 5 provides a seal between the spark plug 100 and the engine head 200, and gas leakage from the internal combustion engine through the mounting screw hole 201 is thereby prevented.

The metallic shell 50 has a thin-walled crimp portion 53 extending rearward from the tool engagement portion 51. The metallic shell 50 further has a compression deformable portion 58 which also has a reduced wall thickness as in the case of the thin-walled crimp portion 53 and which is disposed between the seal portion 54 and the tool engagement portion 51. Annular ring members 6 and 7 are interposed between the inner circumferential surface of the metallic shell 50 and the outer circumferential surface of the rear trunk portion 18 of the ceramic insulator 10 such that they are located in a region extending from the crimp portion 53 to the tool engagement portion 51. The space between the ring members 6 and 7 is filled with powder of talc 9. When the spark plug 100 is produced, the crimp portion 53 is bent inward and pressed frontward, whereby the compression deformable portion 58 is compressed and deformed. As a result of the compressive deformation of the compression deformable portion 58, the ceramic insulator 10 is pressed frontward in the metallic shell 50 through the ring members 6 and 7 and the talc 9. As a result of this pressing, a ledge 15 of the ceramic insulator 10 is pressed through an annular sheet packing 8 against a ledge 56 formed on the inner circumference of the metallic shell 50 at a position corresponding to the screw portion 52, whereby the metallic shell 50 and the ceramic insulator 10 are united together. The compressed sheet packing 8 maintains airtightness between the metallic shell 50 and the ceramic insulator 10, and outflow of combustion gas is thereby prevented. Also, as a result of the pressing, the talc 9 is compressed in the axial direction OD, whereby the airtightness of the metallic shell 50 is improved.

The center electrode 20 is a rod-like electrode disposed at the front end of the axial bore 12 and includes an electrode base metal 21 and a core 22 embedded therein. The electrode base metal 21 is formed of nickel or an alloy containing nickel as a main component, such as INCONEL (trademark) 600. The core 22 is formed of copper or an alloy containing copper as a main component, copper and the alloy having higher thermal conductivity than the electrode base metal 21.

The ground electrode 30 is formed of a metal having high corrosion resistance, and a nickel alloy, for example, is used for the ground electrode 30. The base end of the ground electrode 30 is welded to the front end surface of the metallic shell 50. The ground electrode 30 is bent such that its distal end portion and the front end face of the center electrode 20 face each other on the axis O in the axial direction OD. A spark gap across which spark discharge occurs is formed between the distal end portion of the ground electrode 30 and the front end portion of the center electrode 20.

A connecting portion 2 for electrically connecting the metal terminal 40 with the center electrode 20 is disposed in the axial bore 12 of the ceramic insulator 10. The connecting portion 2 includes an upper seal member **4*a*, a lower seal member 4*b*, and a cylindrical columnar resistor 3 sandwiched between these seal members. Each of the upper seal member 4*a* and the lower seal member 4*b* is a well-known seal member which is high in electrical conductivity and has a resistance of 0.1Ω or lower. The upper seal member 4*a* and the lower seal member 4*b* are formed of a material containing powder of a metal such as a copper, tin, or iron, and powder of borosilicate glass. The resistor 3 has a resistance of, for example, 1Ω or higher and is formed of a material containing zirconia powder, alumina powder, carbon black, glass powder, PVA binder, etc. The upper seal member 4***a*, the lower seal member 4*b*, and the resistor 3 are formed in the axial bore 12 in the following manner, for example. The center electrode 20 is inserted into the axial bore 12 from its rear end, and the powdery material of the lower seal member 4*b* is placed on the center electrode 20 and then pressed with a pressing rod. Then, the powdery material of the resistor 3 is placed on the pressed powdery material of the lower seal member 4*b* and pressed with the pressing rod. The powdery material of the upper seal member 4*a* is placed on the pressed powdery material of the resistor 3 and pressed with the pressing rod. Subsequently, the metal terminal 40 is inserted into the rear end of the axial bore 12. The ceramic insulator 10 is heated, and then the metal terminal 40 is pressed into the axial bore 12. The powdery materials of the materials of the upper seal member 4*a*, the lower seal member 4*b*, and the resistor 3 in the axial bore 12 are thereby melted and then cooled. In this manner, the upper seal member 4*a*, the lower seal member 4*b*, and the resistor 3 are solidified in the axial bore 12, and the center electrode 20 and the metal terminal 40 are fixed in the axial bore 12.

In the present embodiment, when the resistor 3 is formed in the manner described above, the powdery material of the resistor 3 is placed in the axial bore 12 while the amount of carbon black in the powdery material is appropriately controlled to generate a resistance distribution in the axial direction OD. More specifically, the ratio of carbon black mixed into the powdery material is increased in the axial direction OD from the front side to the rear side, so that the resistance increases toward the front side in the axial direction OD.

Figure 2:
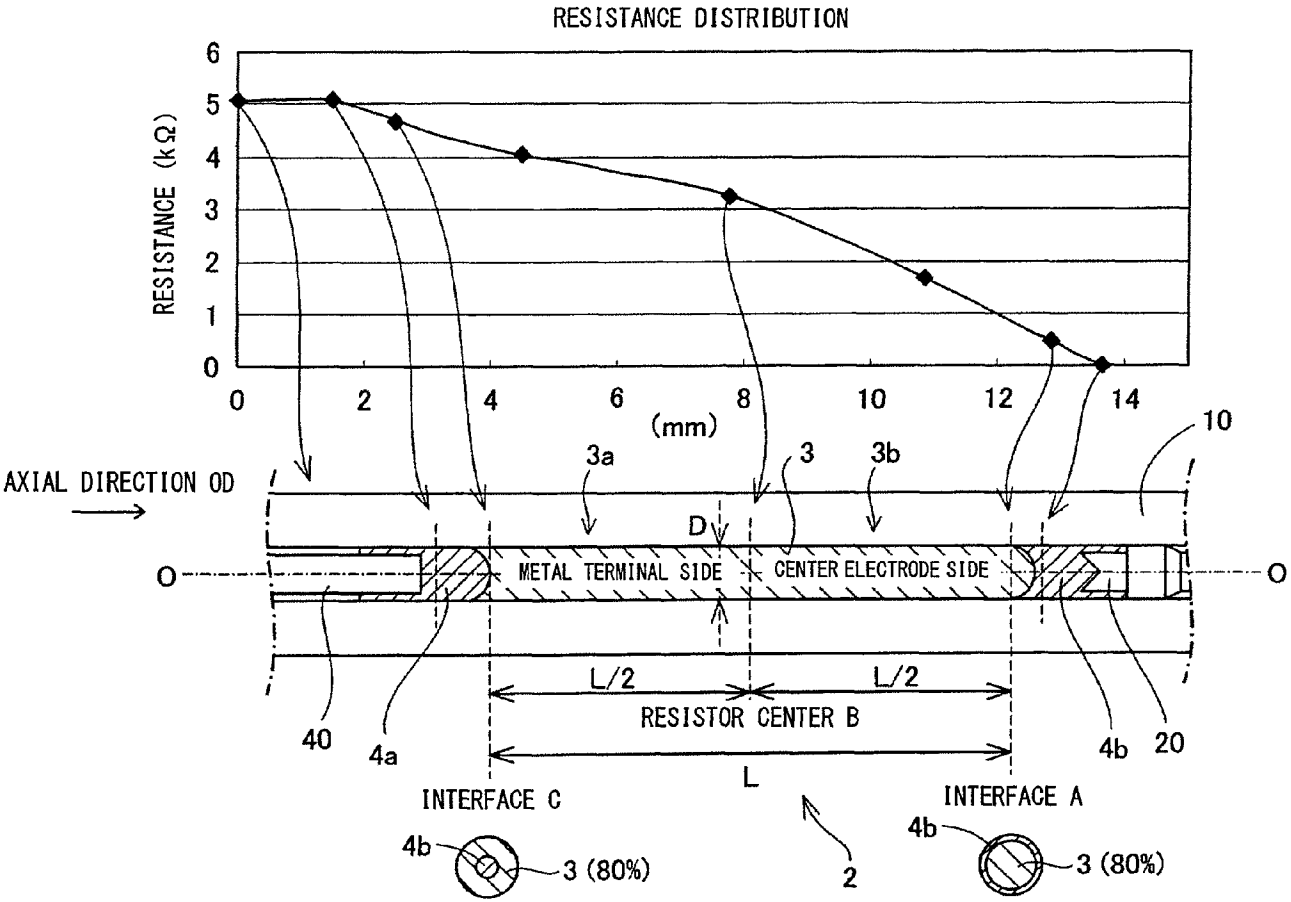
FIG. 2 is a diagram showing an example resistance distribution in a resistor.

FIG. 2 is a diagram showing an example of the resistance distribution in the resistor 3. An enlarged cross section around the connecting portion 2 (the upper seal member 4*a*+the resistor 3+the lower seal member 4*b*) of the spark plug 100 is shown in the lower part of FIG. 2. A graph showing the resistances in the connecting portion 2 at different positions in the axial direction OD is shown in the upper part of FIG. 2. The horizontal axis of the graph represents different positions in the axial bore 12 in the axial direction OD, and the vertical axis represents the resistance of a portion of the resistor 3 extending from the lower seal member 4*b* disposed frontward of the resistor 3 in the axial direction OD to each of the different portions.

In the present embodiment, the resistance of the resistor 3 gradually increases in the axial direction OD from the lower seal member 4*b* to the upper seal member 4*a*, as shown in FIG. 2. In addition, the gradient of the resistance in a portion extending from an interface A between the lower seal member 4*b* and the resistor 3 to the center B of the resistor 3 is different from the gradient of the resistance in a portion extending from the center B of the resistor 3 to an interface C between the upper seal member 4*a* and the resistor 3. Specifically, the gradient in the former portion is steeper, and the gradient in the latter portion is less steep. More specifically, in the resistor 3, the resistance of the portion extending from the center B to the interface A (this portion is hereinafter referred to as a "center electrode-side resistor portion 3*b*," and this resistance is referred to as a "center electrode-side resistance R1") is larger than the resistance of the portion extending from the center B to the interface C (this portion is hereinafter referred to as a "metal terminal-side resistor portion 3*a*," and this resistance is referred to as a "metal terminal-side resistance R2"). In the present embodiment, the "interface A" is a radial cross section of the axial bore 12 at the frontmost end of a portion in which the resistor 3 occupies at least 80% of the cross sectional area. The "interface C" is a radial cross section of the axial bore 12 at the rearmost end of the portion in which the resistor 3 occupies at least 80% of the cross sectional area. The positions of the interfaces A and C can be determined by image analysis of cross-sectional images of the connecting portion 2. In the example of the resistance distribution shown in FIG. 2, the center electrode-side resistance R1 is about 3 kΩ, and the metal terminal-side resistance R2 is about 2 kΩ. Therefore, the overall resistance of the resistor 3 is about 5 kΩ. Preferably, the metal terminal-side resistance R2 is at least 100 Ω.

To measure the resistance of the resistor 3 at an arbitrary cross section, first, the resistor 3 is ground from the side toward the center electrode 20 and from the side toward the metal terminal 40 to obtain cross sections to be used for the measurement of the resistance. Subsequently, silver paste is applied to these cross sections, and the resistance between the cross sections is measured. In this manner, the resistance of the resistor 3 at an arbitrary cross section can be measured. The center B of the resistor 3 can be determined by performing grinding from the side toward the center electrode 20 until the interface A appears, also performing grinding from the side toward the metal terminal 40 until the interface C appears, and then determining the position of the center between the interfaces A and C on the axis O. The resistances of the center electrode-side resistor portion 3*b* and the metal terminal-side resistor portion 3*a* can be measured as follows. For example, a silver paste is applied to the cross sections at the interfaces A and C, and the overall resistance of the resistor 3 is measured. Then the resistor 3 is ground from the side toward the center electrode 20 to the center B. The silver paste is applied to the cross section at the center B, and the resistance between the opposite ends of the remaining resistor 3 (i.e., the metal terminal-side resistor portion 3*a*) is measured. The metal terminal-side resistance R2 can be measured in this manner. The center electrode-side resistance R1 can be determined by subtracting the metal terminal-side resistance R2 from the overall resistance of the resistor 3 that has been measured prior to the measurement of the metal terminal-side resistance R2. In this example, the resistor 3 is ground from the side toward the center electrode 20 to the center B. However, the resistor 3 may be ground from the side toward the metal terminal 40 to the center B to determine the center electrode-side resistance R1 and the metal terminal-side resistance R2. In addition, the resistor 3 may be cut at the center B to separate the metal terminal-side resistor portion 3*a* and the center electrode-side resistor portion 3*b* from each other, and their resistances may be measured independently.

FIG. 3 is a table showing the results of an evaluation test which was performed for 35 sample spark plugs 100 in order to investigate the relation between radio noise and the difference in resistance between the center electrode-side resistor portion 3*b* and the metal terminal-side resistor portion 3*a* (R1-R2). As shown in FIG. 3, in samples Nos. 1 to 9, the difference between the center electrode-side resistance R1 and the metal terminal-side resistance R2 was varied from 1.5 kΩ to −1.5 kΩ, with the overall resistance of the resistor 3 maintained at 2 kΩ. In samples Nos. 10 to 18, the difference between the center electrode-side resistance R1 and the metal terminal-side resistance R2 was varied from 4 kΩ to −4 kΩ, with the overall resistance of the resistor 3 maintained at 5 kΩ. In samples Nos. 19 to 35, the difference between the center electrode-side resistance R1 and the metal terminal-side resistance R2 was varied from 6 kΩ to −6 kΩ, with the overall resistance of the resistor 3 maintained at 10 kΩ.

FIG. 3 shows the results of a test called the box method defined in CISPR12 and performed to evaluate the radio noise performance of each sample. More specifically, a "two-double circle (indicating a rating of very good)" was given to a sample with radio noise reduced by at least 5 dB as compared with reference radio noise generated by a sample in which the difference between the center electrode-side resistance R1 and the metal terminal-side resistance R2 was 0Ω. A "double circle (indicating a rating of good)" was given to a sample with radio noise reduced by 2.5 dB or more as compared with the reference radio noise, and a "circle (indicating a rating of fair)" was given to a sample with radio noise reduced by 1.5 dB or more as compared with the reference radio noise. In addition, a "cross (indicating a rating of poor)" was given to a sample with radio noise increased by 1.5 dB or more as compared with the reference radio noise. As can be found from the evaluation results for the samples in FIG. 3, irrespective of whether the overall resistance of the resistor 3 is 2 kΩ, 5 kΩ, or 10 kΩ, the level of radio noise can be effectively reduced as compared with the radio noise generated by a sample with no difference in resistance, so long as the center electrode-side resistance R1 is larger than the metal terminal-side resistance R2 by at least 0.5 kΩ, preferably at least 1.0 kΩ. Therefore, in the spark plug 100 of the present embodiment, the resistance of the center electrode-side resistor portion 3*b* of the resistor 3 is set to be larger than the resistance of the metal terminal-side resistor portion 3*a* by at least 0.5 kΩ, preferably at least 1.0 kΩ.

Figure 4:
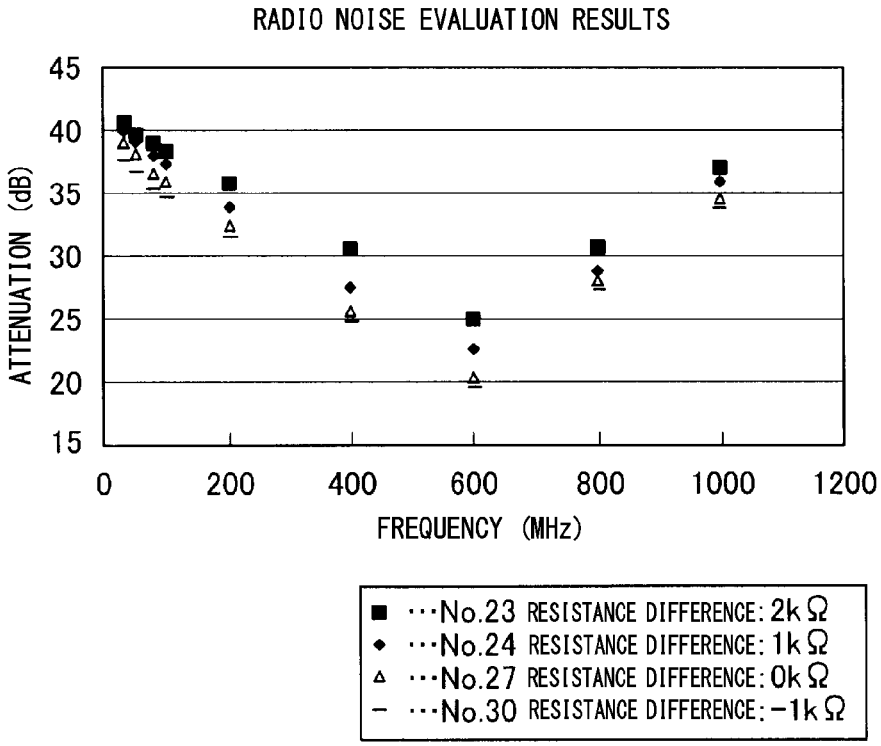
FIG. 4 is a graph showing attenuation of radio noise versus frequency for different samples.

FIG. 4 is a graph showing attenuation of radio noise versus frequency for different samples. Four representative samples (samples Nos. 23, 24, 27, and 30) selected from the samples shown in FIG. 3 were evaluated at different frequencies using the box method described above. As can be seen from the evaluation results shown in FIG. 4, when the center electrode-side resistance R1 was larger than the metal terminal-side resistance R2 as in samples Nos. 23 and 24, the amount of attenuation of radio noise was larger than that in sample No. 27 with no difference in resistance over the entire frequency range of 0 to 1,000 MHz. For example, in sample No. 24 in which the difference in resistance was 1 kΩ, the amount of attenuation at around 400 to 600 MHz was larger by up to 2.5 dB than that in sample No. 27 with no difference in resistance. In sample No. 23 in which the difference in resistance was 2 kΩ, the amount of attenuation at around 400 to 600 MHz was larger by up to 5 dB than that in sample No. 27 with no difference in resistance. However, in sample No. 30 in which the center electrode-side resistance R1 was smaller than the metal terminal-side resistance R2, the amount of attenuation of radio noise was smaller than that in sample No. 27 with no difference in resistance over the entire frequency range.

Figure 5:
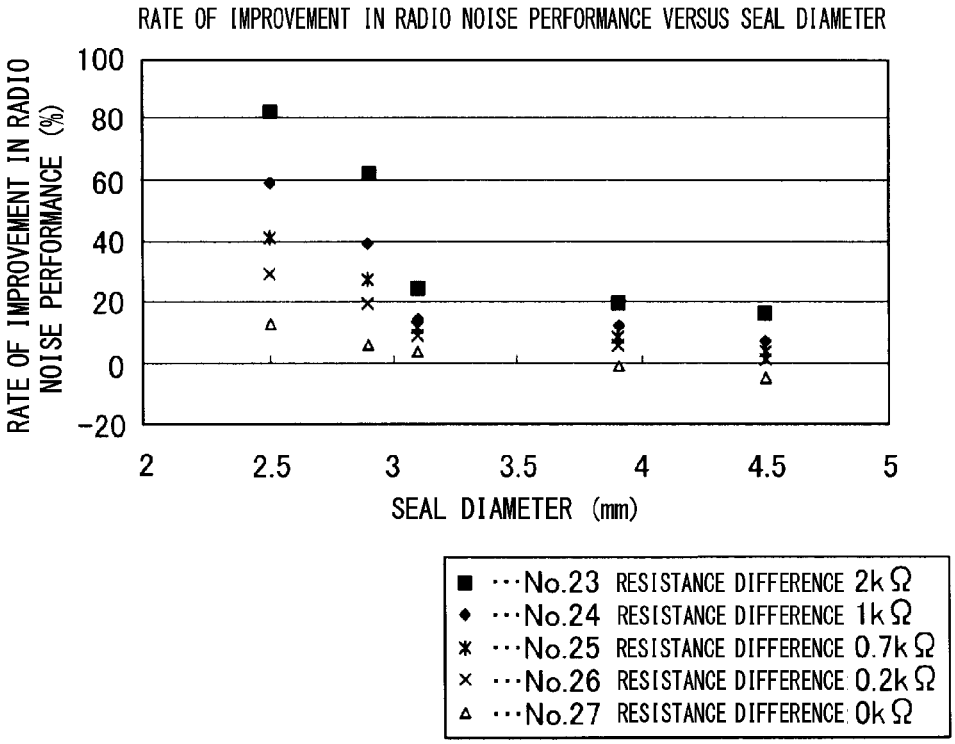
FIG. 5 is a graph showing the rate of improvement in radio noise performance versus the seal diameter of the resistor.

FIG. 5 is a graph showing the rate of improvement in radio noise performance versus the seal diameter D of the resistor 3 in a middle frequency range (100 MHz). The rate of improvement in radio noise performance was determined for five representative samples (samples Nos. 23, 24, 25, 26, and 27) selected from the samples shown in FIG. 3, while the seal diameter D representing the diameter of the resistor 3 (see FIG. 2) was varied. Each value shown in FIG. 5 represents the rate of improvement in attenuation of radio noise with respect to the attenuation in sample No. 27 with a seal diameter D of 3.9 mm and no difference between the center electrode-side resistance R1 and the metal terminal-side resistance R2. As can be found from the evaluation results shown in FIG. 5, when the seal diameter D was 2.9 mm or smaller, the rate of improvement in radio noise performance increased significantly as the difference in resistance increased. For example, even in sample No. 27 with no difference in resistance, the radio noise performance was improved by about 7% by merely decreasing the seal diameter from 3.9 mm to 2.9 mm. However, even in the case where the difference in resistance was relatively small (0.2 kΩ) as in the case of sample No. 26, the rate of improvement was at least twice that in sample No. 27 with no difference in resistance. According to the above evaluation results, the diameter (seal diameter D) of the resistor 3 in the spark plug 100 of the present embodiment is set to 2.9 mm or smaller.

In the spark plug 100 of the embodiment described above, the resistor 3 disposed in the axial bore 12 has a resistance distribution, and the resistance of the center electrode-side resistor portion 3*b* located close to the spark gap is set to be larger than the resistance of the metal terminal-side resistor portion 3*a*. This setting effectively suppresses the level of radio noise generated upon occurrence of spark discharge. Since it is not necessary to change the overall resistance of the resistor 3, deterioration of sparking performance can be suppressed. It is conventionally known that low-frequency radio noise is reduced by increasing the overall resistance of the resistor 3 and that high-frequency radio noise is reduced by increasing the length of the resistor 3 in the axial direction OD. However, in the present embodiment, the resistance of the center electrode-side resistor portion 3*b* is set to be larger than the resistance of the metal terminal-side resistor portion 3*a*. This setting reduces the level of radio noise not in a local frequency range but in a wide frequency range, as shown in FIG. 4.

In the spark plug 100 of the present embodiment, the center electrode-side resistance R1 is larger than the metal terminal-side resistance R2 by at least 0.5 kΩ, preferably at least 1.0 kΩ. In addition, the metal terminal-side resistance is set to 100Ω or larger, and the diameter of the resistor 3 is set to 2.9 mm or smaller. This setting more effectively reduces the level of radio noise.

Although the embodiment of the present invention has been described, the present invention is not limited to the embodiment, and various other configurations can be used within the spirit of the invention. For example, the following modifications are possible.

In the above embodiment, the connecting portion 2 is configured to include the resistor 3 and the glass seal members (the upper seal member 4*a* and the lower seal member 4*b*) disposed on opposite sides of the resistor 3. However, for example, the upper seal member 4*a* may be omitted from the connecting portion 2. In this configuration, the resistor 3 is in direct contact with the metal terminal 40. Alternatively, the lower seal member 4*b* may be omitted. In this configuration, the resistor 3 is in direct contact with the center electrode 20. Alternatively, both the upper seal member 4*a* and the lower seal member 4*b* may be omitted. In this configuration, the resistor 3 is in direct contact with the metal terminal 40 and also in direct contact with the center electrode 20. When the upper seal member 4*a* is omitted, the interface C may be a cross section at the frontmost end of a region in which the resistor 3 is in contact with the metal terminal 40. When the lower seal member 4*b* is omitted, the interface A may be a cross section at the rearmost end of a region in which the resistor 3 is in contact with the center electrode 20.

In the above embodiment, the resistance of the resistor 3 gradually increases from the interface A toward the interface C. However, the section extending from the interface A to the interface C may include a portion in which the resistance decreases, so long the resistance of the center electrode-side resistor portion 3*b* is larger than the resistance of the metal terminal-side resistor portion 3*a*.

In the above embodiment, the resistor 3 has a substantially cylindrical columnar shape, and the seal diameter thereof is constant in the axial direction OD. However, the seal diameter of the metal terminal-side resistor portion 3*a* may be different from the seal diameter of the center electrode-side resistor portion 3*b*. In this case, the resistance of the center electrode-side resistor portion 3*b* can be larger than the resistance of the metal terminal-side resistor portion 3*a* without changing the material of the resistor 3.

DESCRIPTION OF REFERENCE NUMERALS

2: connecting portion
3: resistor
3*a*: metal terminal-side resistor portion
3*b*: center electrode-side resistor portion
4*a*: upper seal member
4*b*: lower seal member
5: gasket
6: ring member
8: sheet packing
9: talc
10: ceramic insulator
12: axial bore
13: leg portion
15: ledge
17: front trunk portion
18: rear trunk portion
19: flange portion
20: center electrode
21: electrode base metal
22: core
30: ground electrode
40: metal terminal
50: metallic shell
51: tool engagement portion
52: mounting screw portion
53: crimp portion
54: seal portion
55: seat surface
56: ledge
58: compression deformable portion
59: screw neck
100: spark plug
200: engine head
201: mounting screw hole
205: mounting surface around opening
501: insertion hole

The invention claimed is:

1. A spark plug comprising:

an insulator having an axial bore extending in an axial direction;

a center electrode disposed at one end of the axial bore;

a metal terminal disposed at the other end of the axial bore; and a connecting portion that electrically connects the center electrode with the metal terminal within the axial bore;

wherein the connecting portion includes a resistor, and a center electrode-side resistance of the resistor is larger than a metal terminal-side resistance of the resistor, the center electrode-side resistance being a resistance of a portion of the resistor that extends from a center thereof toward the center electrode in the axial direction, the metal terminal-side resistance being a resistance of a portion of the resistor that extends from the center thereof toward the metal terminal.

2. A spark plug according to claim 1, wherein a material forming the portion of the resistor that extends from the center thereof toward the center electrode in the axial direction has a resistance larger than a resistance of a material forming the portion of the resistor that extends from the center thereof toward the metal terminal.

3. A spark plug according to claim 1 or 2, wherein the center electrode-side resistance is larger than the metal terminal-side resistance by at least 0.5 kΩ.

4. A spark plug according to claims 1 or 2, wherein the center electrode-side resistance is larger than the metal terminal-side resistance by at least 1.0 kΩ.

5. A spark plug according to claims 1 or 2, wherein the metal terminal-side resistance is 100Ω or larger.

6. A spark plug according to claims 1 or 2, wherein the resistor has a substantially cylindrical shape, and has a diameter of 2.9 mm or smaller.

* * * * *